US008078280B2

(12) United States Patent
Sage

(10) Patent No.: US 8,078,280 B2
(45) Date of Patent: Dec. 13, 2011

(54) IMPLANTABLE BIOMEDICAL ELECTRICAL CONNECTORS HAVING INTEGRAL SIDE AND INNER WALLS

(75) Inventor: Shahn S. Sage, Andover, MN (US)

(73) Assignee: Medtronic, Inc., Minneapolis, MN (US)

( * ) Notice: Subject to any disclaimer, the term of this patent is extended or adjusted under 35 U.S.C. 154(b) by 613 days.

(21) Appl. No.: 10/423,190

(22) Filed: Apr. 25, 2003

(65) Prior Publication Data

US 2004/0215303 A1 Oct. 28, 2004

(51) Int. Cl.
*H01R 13/18* (2006.01)

(52) U.S. Cl. ..... 607/37; 439/843

(58) Field of Classification Search ..... 607/37, 607/38; 439/349, 252, 909, 939, 843–847, 439/851–854

See application file for complete search history.

(56) References Cited

U.S. PATENT DOCUMENTS

| | | | | | |
|---|---|---|---|---|---|
| 4,550,972 | A | | 11/1985 | Romak | |
| 4,603,696 | A | * | 8/1986 | Cross et al. | 607/27 |
| 4,898,173 | A | * | 2/1990 | Daglow et al. | 607/37 |
| 5,358,516 | A | * | 10/1994 | Myers et al. | 607/116 |
| 5,411,348 | A | | 5/1995 | Balsells | 403/326 |
| 5,474,309 | A | | 12/1995 | Balsells | 277/163 |
| 5,503,375 | A | | 4/1996 | Balsells | 267/167 |
| 5,545,842 | A | | 8/1996 | Balsells | 174/35 |
| 5,575,487 | A | | 11/1996 | Balsells | 277/169 |
| 5,599,027 | A | | 2/1997 | Balsells | 277/163 |
| 5,615,870 | A | | 4/1997 | Balsells | 267/167 |
| 5,709,371 | A | | 1/1998 | Balsells | 267/167 |
| 5,730,628 | A | * | 3/1998 | Hawkins | 439/843 |
| 5,766,042 | A | | 6/1998 | Ries et al. | 439/668 |
| 5,791,638 | A | | 8/1998 | Balsells | 267/167 |
| 5,843,141 | A | | 12/1998 | Bischoff et al. | 607/37 |
| 5,921,803 | A | * | 7/1999 | Mori | 439/387 |
| 5,979,904 | A | | 11/1999 | Balsells | 277/554 |
| 5,992,856 | A | | 11/1999 | Balsells et al. | 277/553 |
| 5,997,367 | A | * | 12/1999 | Nowak et al. | 439/853 |
| 6,050,572 | A | | 4/2000 | Balsells et al. | 277/551 |
| 6,161,838 | A | | 12/2000 | Balsells | 277/511 |

(Continued)

FOREIGN PATENT DOCUMENTS

| | | |
|---|---|---|
| DE | 3510895 | 10/1986 |
| DE | 4432921 | 3/1995 |
| EP | 0196368 | 10/1986 |

(Continued)

OTHER PUBLICATIONS

PCT International Search Report for International Application No. PCT/US2004/012266, filed Apr. 20, 2004.

*Primary Examiner* — Michael Kahelin

(74) *Attorney, Agent, or Firm* — Fredrikson & Byron, P.A.

(57) ABSTRACT

Low resistivity, implantable electrical connectors and biomedical leads having the connectors mechanically coupled to low resistivity wires in a non-welded attachment to extend implanted device battery life. One implantable electrical connector has an inner longitudinal aperture and two opposed flanges angled away from the longitudinal axis and coupled through a radially flexible inner circumferential wall to form a single piece, low resistance path. An elastic member can urge the flexible inner circumferential wall portion inward. In one connector, the electrically conductive, flexible inner wall portion can resiliently contact an inserted electrode. The connector body can include at least one hole adjacent a mechanically deformable sidewall for mechanically securing an electrical conductor inserted within the hole. The low resistivity, implantable, biocompatible electrical connectors and leads can be used in neurological and cardiac applications.

9 Claims, 8 Drawing Sheets

U.S. PATENT DOCUMENTS

| | | | | |
|---|---|---|---|---|
| 6,205,358 | B1 | 3/2001 | Haeg et al. | 607/36 |
| 6,264,205 | B1 | 7/2001 | Balsells | 277/551 |
| 6,430,442 | B1 * | 8/2002 | Peters et al. | 607/37 |
| 2003/0163171 | A1 * | 8/2003 | Kast et al. | 607/36 |

FOREIGN PATENT DOCUMENTS

| | | |
|---|---|---|
| ES | 285894 | 10/1985 |
| WO | WO 85/04766 | 10/1985 |
| WO | WO 01/99239 | 12/2001 |

* cited by examiner

IMPLANTABLE BIOMEDICAL ELECTRICAL CONNECTORS HAVING INTEGRAL SIDE AND INNER WALLS

BACKGROUND OF INVENTION

1. Field of the Invention

The present invention is related generally to medical devices. More specifically, the present invention is related to implantable electrical connectors that find one use in neurological stimulation leads.

2. Description of Related Art

Neurological stimulation leads are increasingly used in a variety of applications. One common use for neurological stimulation leads is paresthesia, the stimulation of the spinal cord from within the spine through the application of artificially generated electrical signals. This artificial stimulation can be used to control pain in chronic pain patients by effectively masking pain signals at the spine.

A neurological stimulation lead is commonly used to deliver electrical signals. One such lead is formed of polymeric material, for example, polyurethane or silicone. The lead can be nominally 1 mm in outer diameter and about 20 cm in length. A typical lead may have a series of electrodes formed as bands or rings disposed in a spaced apart relationship in a lead distal region. The distal region of the lead can later be introduced into the spinal column. One exemplary lead may have eight electrodes in the distal region, with each electrode having its own conductor extending along the length of the lead to a lead proximal region. The lead proximal region of the lead can have a corresponding set of band or ring connectors, one for each corresponding electrode in the distal region. Each proximal region connector can thus be connected to one distal electrode in a typical configuration. The connectors can be used to couple the proximal end of the lead to a lead extension, which can in turn be coupled to an implantable pulse generator (IPG).

A typical connector is an electrical connector serving as a male electrical connection, adapted to be received within a corresponding female electrical connector in a lead extension. One such female electrical connector includes a cylindrical outer housing having a transverse circumferential groove or channel within the interior face of the housing. A metallic coil spring can be disposed within the circumferential channel, providing electrical continuity between the spring and the outer metallic housing. The male connector bearing an electrically conducting outer surface can be suitably dimensioned to be insertable through the spring with minimum force. The spring can provide a radially inward directed force on the male connector outer surface to establish contact between the male connector and the spring. In one lead extension proximal region, a set of seven, spring loaded, tool-less connectors are aligned coaxially with each other, along with a single connector that includes a setscrew to mechanically fix the inserted lead within the lead extension. The seven tool-less lead extension connectors can be imbedded within the tube or be covered with an insulating sleeve or boot. The setscrew lead extension connector is typically insulated to prevent unwanted electrical contact with the body.

The eight lead extension proximal connectors can thus be electrically coupled to eight corresponding connectors of an inserted lead. The lead extension can provide added length to extend the reach of the lead to a more distantly placed IPG. Some lead extensions are between about 20 and 50 cm in length.

Neurological leads are increasingly used, and implanted for long periods of time. The IPG is most typically powered by a battery, which is implanted with the IPG. In some IPGs, the batteries or IPGs themselves can receive power input through the skin through radio frequency (RF) energy from a transmitter disposed outside of the patient. In the majority of cases however, the IPG has an implanted battery with a limited life.

The battery life of the IPG is dependent upon the current delivered to the electrode distal end and upon the electrical losses in the conductors between the IPG and the lead distal end. Current lead conductors utilize MP35N, a nickel alloy widely used because of its biocompatible characteristics. While nickel alloy is a good material in many respects, it has the less than optimal property of moderate electrical resistivity. This means that some of the battery power goes to resistive heating of the nickel alloy wires, rather than to pain relief.

The nickel alloy wires are typically each welded to a connector, a practice of long standing that has previously proved suitable, but uses wire having moderate resistively. Silver or silver core wires having a lower resistively than nickel alloy can be used. The silver wires can also be welded, but present a problem. The silver can oxidize and turn brittle, a less than optimal property. For this reason, among others, the wire typically has a silver core clad in a nickel alloy, for example, MP35N. The nickel alloy clad silver core wire can also be welded, but the welding itself can present difficulties. The silver has a lower melting point than the surrounding nickel alloy. When such nickel alloy clad silver core wire is welded, the silver core can melt prior to the nickel alloy, puddle, and contaminate the weld.

The current two-piece connectors also add resistivity by nature of their two-piece construction, as there is some resistance in the electrical path between the two pieces. Specifically, while the outer housing and inner spring may both be metallic, the electrical contact between the two is not perfect.

What would be most advantageous are implantable leads having very low resistance both within the connector and in an assembly having a conductor connected to the connector. What would be desirable are neurological lead extensions and connectors that allow for use of silver core wire in order to increase battery life of implanted IPGs.

SUMMARY OF INVENTION

The present invention provides an implantable electrical connector having an inner longitudinal aperture therethrough, a connector body including a first flange having at least one region angled away from the longitudinal axis, wherein the first flange is integrally formed with and coupled to an electrically conductive and radially flexible inner circumferential wall portion disposed about the inner longitudinal aperture. The connector preferably has no dimension larger than about one quarter inch and is formed of a biocompatible, electrically conductive material.

The connector can further include an elastic member disposed about, and bearing radially inward against, the flexible inner circumferential wall portion. The connector body can have at least one hole therein having at least one mechanically deformable sidewall for mechanically securing an electrical conductor inserted within the hole. The body can further include a second flange coupled to the radially flexible inner circumferential wall portion and having at least one region angled away from the central longitudinal axis.

One connector further includes an electrically conductive tube extending between and secured to the first and second flanges, wherein the tube has a mechanically deformable sidewall. The connector can include a pair of support washers, one secured to each of the flanges. The connector radially flexible inner circumferential wall can include numerous ribs supported at each end and separated by inter-rib spaces, or by a plurality of cantilevered fingers supported only at one end.

The present invention also includes a method for making an implantable biomedical electrical connector. The method can include providing an electrically conductive sheet formed of a biocompatible material and having a top edge, a bottom edge, two opposite side edges, and a longitudinal intermediate region extending between the side edges and being substantially parallel to the top and bottom edges. The sheet can also include a plurality of elongate members separated by respective elongate inter-member apertures formed through the sheet. The sheet can be made by methods including stamping, laser machining, and/or chemical etching.

The method can include shaping the conductive sheet such that the intermediate region forms a substantially round and/or cylindrical shape and the side edges are brought to an opposed, close relationship to each other. The conductive sheet can be bent such that the intermediate region forms a concave surface, a convex surface, and the top and bottom edges are brought closer together. An elastic member can be provided and disposed around the shaped and bent sheet concave surface to provide resiliency to the plurality of elongate members.

In some methods the shaping step is performed prior to the bending step. In some conductive sheets the elongate members include ribs secured at each end and the inter-member apertures include inter-rib apertures, wherein the bending step forms concave and convex rib surfaces. In other methods, the elongate members include cantilevered fingers secured at only one end and the inter-member apertures include inter-finger apertures, wherein the bending step forms concave and convex finger surfaces. Some conductive sheets are metallic while other conductive sheets have non-conductive bodies and conductive coatings, plating, or layers on at least one surface.

Some methods also utilize an electrically conductive tube having two opposite ends, and include securing the tube opposite ends to the shaped and bent sheet concave surface. An electrical conductor can be inserted within the electrically conductive tube and the tube mechanically deformed about the inserted conductor to form a mechanical and electrical connection between the tube and the conductor. Some methods include wire containing at least about 10 percent silver, and optionally and at least about 10 percent nickel alloy, in the electrical conductor.

The present invention further includes implantable biomedical electrical connectors made by the methods described in the present application. The integrally formed flexible members and flanges can provide an easy to manufacture electrical connector having very low electrical resistivity. The present invention also provides an implantable electrical connector assembly including an electrical conductor mechanically attached to the electrical connectors in a non-welded attachment. The electrical conductor can have a portion inserted within a connector hole and be mechanically secured to the housing by a non-welded, mechanical deformation of a sidewall against the inserted conductor portion. The mechanical deformation can be a stake in some embodiments and a crimp in other embodiments. The conductor can be a silver core wire, a nickel alloy cladding over a silver core wire, a bundle of nickel alloy clad silver core wires, or another conductor material. The electrical conductor can include wire containing at least about 10 percent silver and optionally at least about 10 percent nickel alloy.

The present invention also provides an implantable electrical lead including an implantable electrical lead assembly as previously described and an implantable lead body. The implantable electrical lead can include an elongate lead body including a proximal region, a distal region, and having a lumen disposed through at least the lead body proximal region. The lead can also include at least one conductor disposed within the lead body and extending from the proximal region to the distal region. The lead can include at least one electrical connector disposed in the lead body proximal region, wherein the connector is electrically coupled to the conductor in a non-welded mechanical attachment. The lead preferably includes at least one distal contact disposed in the lead body distal region and an electrical contact but with the at least one conductor.

DETAILED DESCRIPTION

The following detailed description should be read with reference to the drawings, in which like elements in different drawings are numbered identically. The drawings, which are not necessarily to scale, depict selected embodiments and are not intended to limit the scope of the invention. Several forms of invention have been shown and described, and other forms will now be apparent to those skilled in art. It will be understood that embodiments shown in drawings and described below are merely for illustrative purposes, and are not intended to limit the scope of the invention as defined in the claims, which follow.

Figure 1:
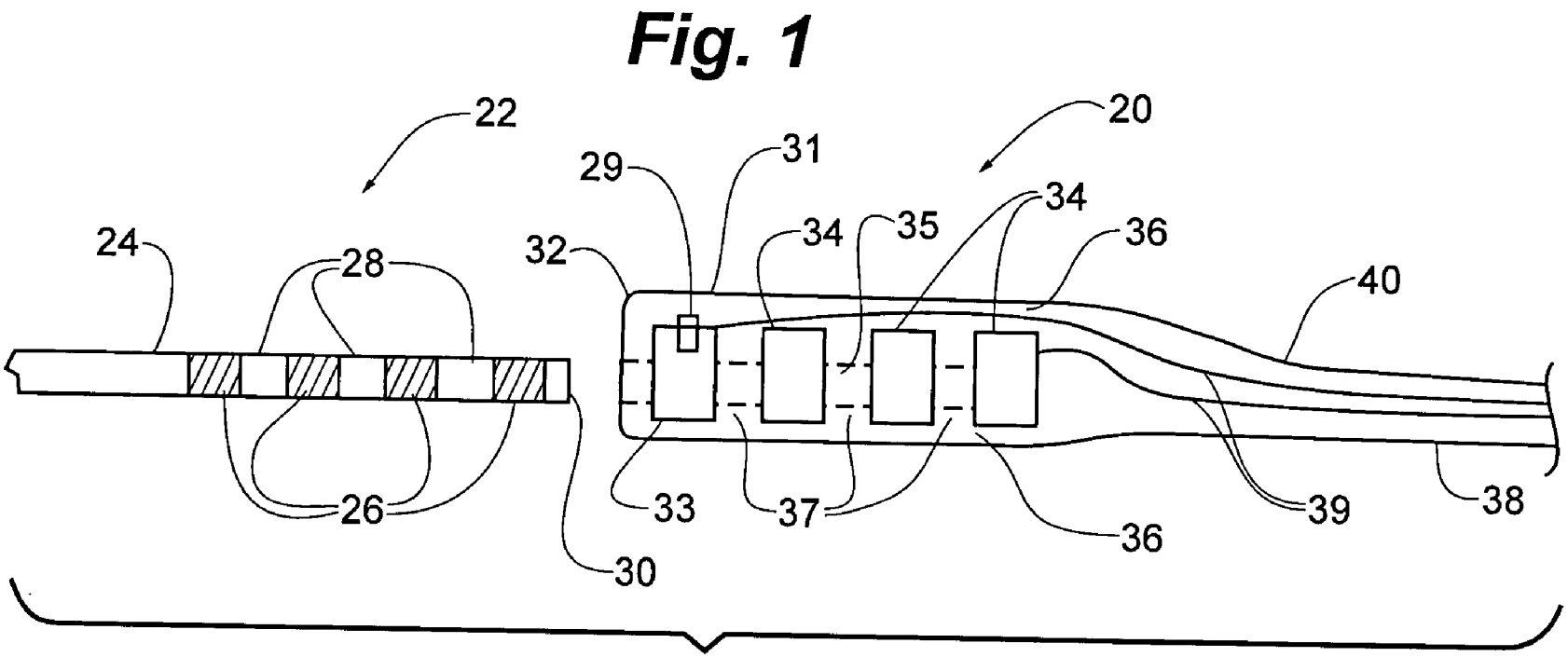
FIG. 1 is a fragmentary side view of an electrical lead oriented for insertion into an electrical lead extension, with the lead extension being cut away to reveal four electrical connectors according to the present invention.

FIG. 1 illustrates an electrical lead 22 positioned to be inserted within an electrical lead extension 20. Lead 22 represents any appropriate biomedical lead. Non-limiting examples include implanted or implantable neurological or cardiac leads. Lead 22 may be seen to have generally a body 24, a proximal end 30, and four external electrical connectors or bands 26, separated by non-conducting regions 28. The electrical connectors, bands, or electrodes 26 may be electrically coupled to four more distal portions of lead 22 through conductors (not visible in FIG. 1).

Lead extension 20 includes generally a body 40, extending from an intermediate region 38 through a proximal region 31 to a proximal end 32. Four electrical connectors, 33 and 34, may be seen within lead extension proximal region 31, separated therebetween by nonconductive regions 37. Nonconductive material 36, for example, polyurethane or silicone rubber, may also be seen disposed about electrical connectors 34. Material 36 may be formed as a sleeve or boot slid axially over the connectors and over part of the lead body in order to insulate the connector external faces from each other and from the external environment.

In some lead extensions, at least one of the electrical connectors is exposed through some the lead extension body material to allow tightening of the electrical connectors about an inserted lead. An example of such an electrical connector is connector 33 having a set screw 29 accessible from the exterior of the lead for mechanically securing an inserted lead. Material 36 can be slid over connectors 34, or 34 and 33, depending on the embodiment. A lumen 35 may be seen extending distally from proximal end 32 through the interiors of electrical connectors 33 and 34 for receiving electrical lead 22. Two electrical conductors 39 may be seen extending through lead body 40 and terminating at two electrical connectors. Other conductors (not visible in FIG. 1) can be secured to the other connectors. The lead extension illustrated in FIG. 2 can include any of the connectors later described in the present application.

Figure 2:
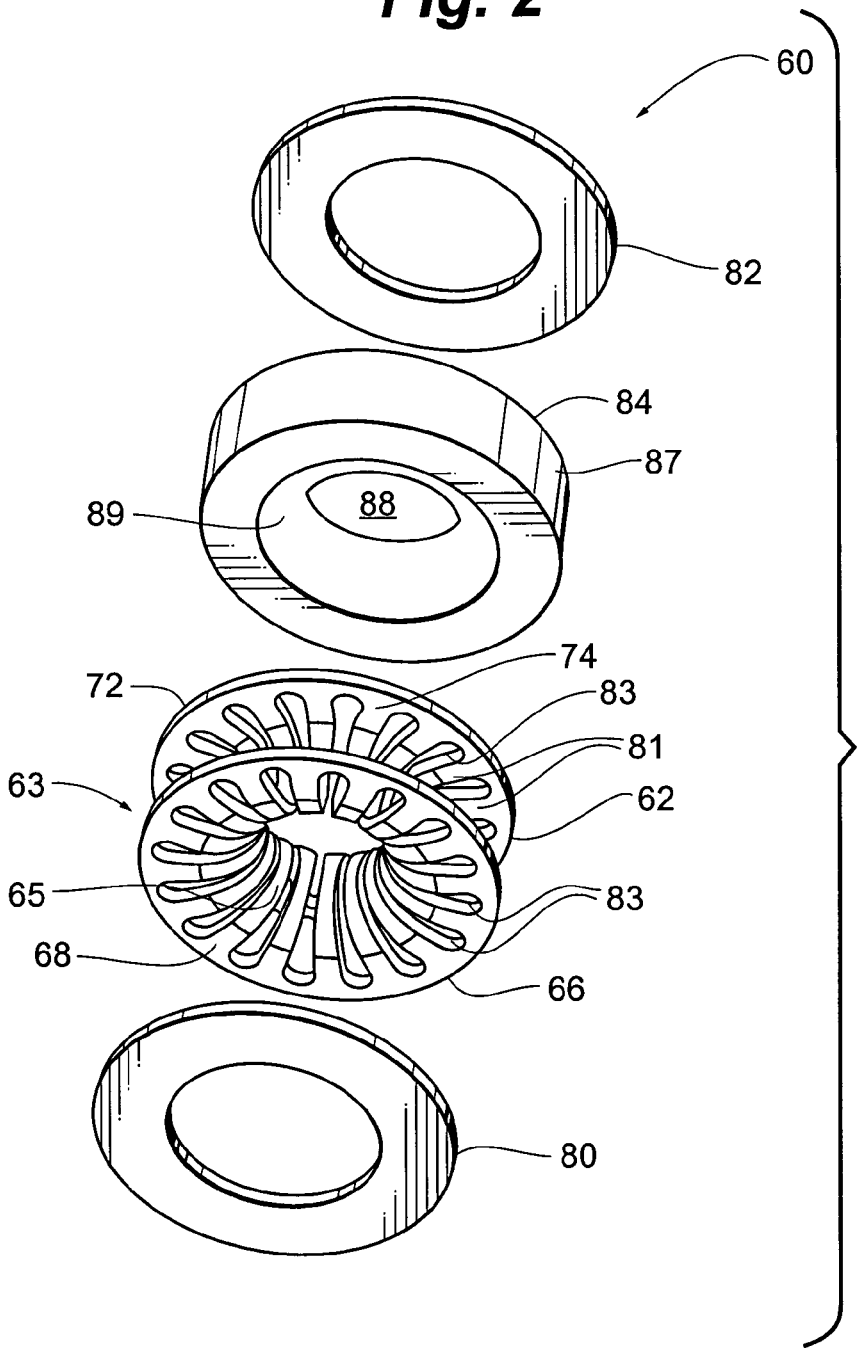
FIG. 2 is an exploded view of an electrical connector including a connector body having an outer facing annular circumferential groove, two support washers, and an elastic band for disposition within the connector body groove.

FIG. 2 illustrates one electrical connector or connector assembly 60. Connector 60 can be used in many applications, including lead extension 20 illustrated in FIG. 1. Connector 60 includes generally a connector body 62, a first end wall support washer 80, a second end wall support washer 82, and an elastic band 84. Connector 62 may be seen to have a central aperture or passage 64 therethrough, defining a central, longitudinal axis. The longitudinal axis also defines a transverse plane orthogonal to the central longitudinal axis, with all directions from the central longitudinal axis along the transverse plane being considered radially outward.

Electrical connector body 62 includes central passage or aperture 64 therethrough, a first end wall or flange 66, and a second, opposing end wall or flange 72. The end walls can angle away from the central longitudinal axis, and, at their extreme radially outward positions, the end walls can extend substantially transverse to the central longitudinal axis of connector body 62. First and second end walls 66 and 72 may also be referred to as lips or flanges. First end wall 66 and second end wall 72 are joined through a radially flexible circumferential inner wall 65. First end wall 66 has an end wall exterior surface 68 while second end wall 72 may be seen to have an interior surface 74. Connector body 62 may be seen to have a plurality of bridges, ribs, or members 81 separated from each other by apertures or inter-rib spaces 83. When an electrical conductor is secured to connector body 62, there will be very little electrical resistance between the point of attachment and inner wall 65.

Elastic band 84 can include an aperture 88 therethrough, an outer portion 87, and an inner portion 89. Elastic band 84 can be an O-ring in some embodiments and a D-ring in other embodiments. Connector body 62 may be seen to have an outer facing, circumferential, annular groove 63, between end wall 66 and end wall 72. In the final assembly, connector 60 can have elastic band 84 disposed within groove 63, to apply radially inward force on the connector body radially flexible inner portion 65.

Figure 3:
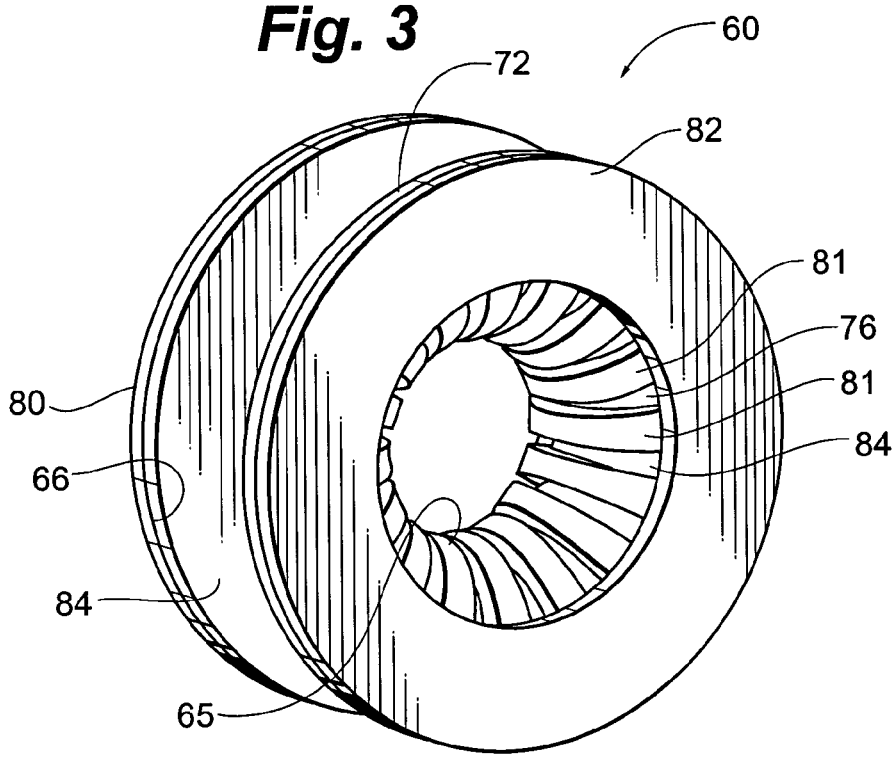
FIG. 3 is a perspective view of the assembled connector of FIG. 2.

FIG. 3 illustrates assembly 60 of FIG. 2 in an assembled form, including elements identically referenced as in FIG. 2. Elastic band 84 is visible in inter-rib apertures 76 formed between ribs 81. End walls 66 and 72 may also be referred to as the connector outer circumferential portion. In preferred embodiments, conductors are secured to connectors in a non-welded mechanical attachment. In other embodiments, connectors are welded to conductor wires. Connector 60 can be welded to a conductor wire to form a lead assembly and lead in some embodiments.

Figure 4:
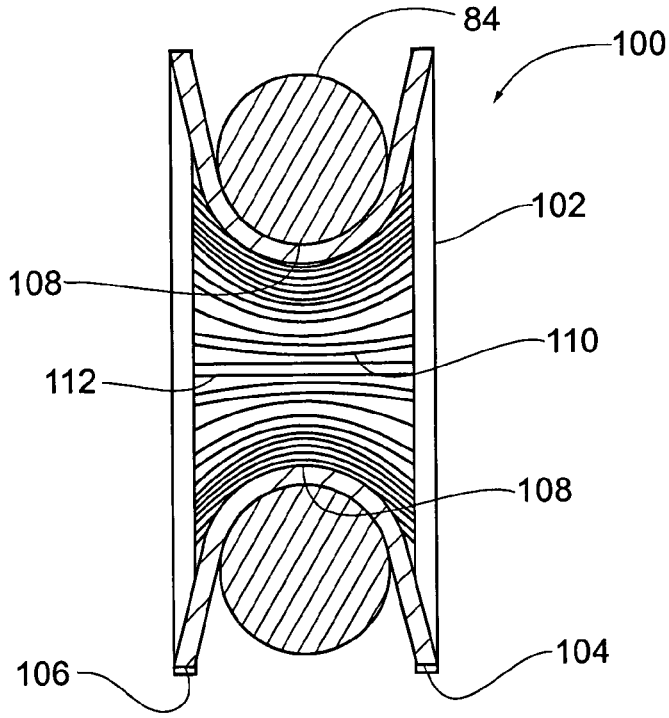
FIG. 4 is a longitudinal, cross sectional view of another electrical connector, similar to that of FIG. 3, but not having support washers.

FIG. 4 illustrates another embodiment of electrical connector, similar in some respects to connector 60 of FIG. 2, but not having end support washers. Connector 100 includes generally a connector body 102 and elastic band 84, previously described. Connector body 102 includes a first flange, end wall, or lip 104 and a second flange, end wall or lip 106. First flange 104 and second flange 106 extend longitudinally toward each other and radially inward over a curved, inner circumferential wall 108. Inner circumferential wall 108 can be formed of a plurality of ribs 110 separated by inter-rib apertures or spaces 112. Inspection of FIG. 4 illustrates that elastic band 84 can assert radially directed inward force against ribs 110. Ribs 110 are preferably radially flexible. The radially inward directed force from electric band 84 together with radially flexible ribs 110 allows the radially flexible ribs to be forced inward against an inserted electrical connector. Similarly, the radial flexibility allows an inserted lead to force flexible ribs 110 outward against elastic band 84. Elastic band 84 can be any suitable elastic member. Elastic band 84 can be formed from an elastic, metal or polymeric material, for example, an elastomeric material. In a preferred embodiment, elastic band 84 is formed from silicone rubber.

Figure 5:
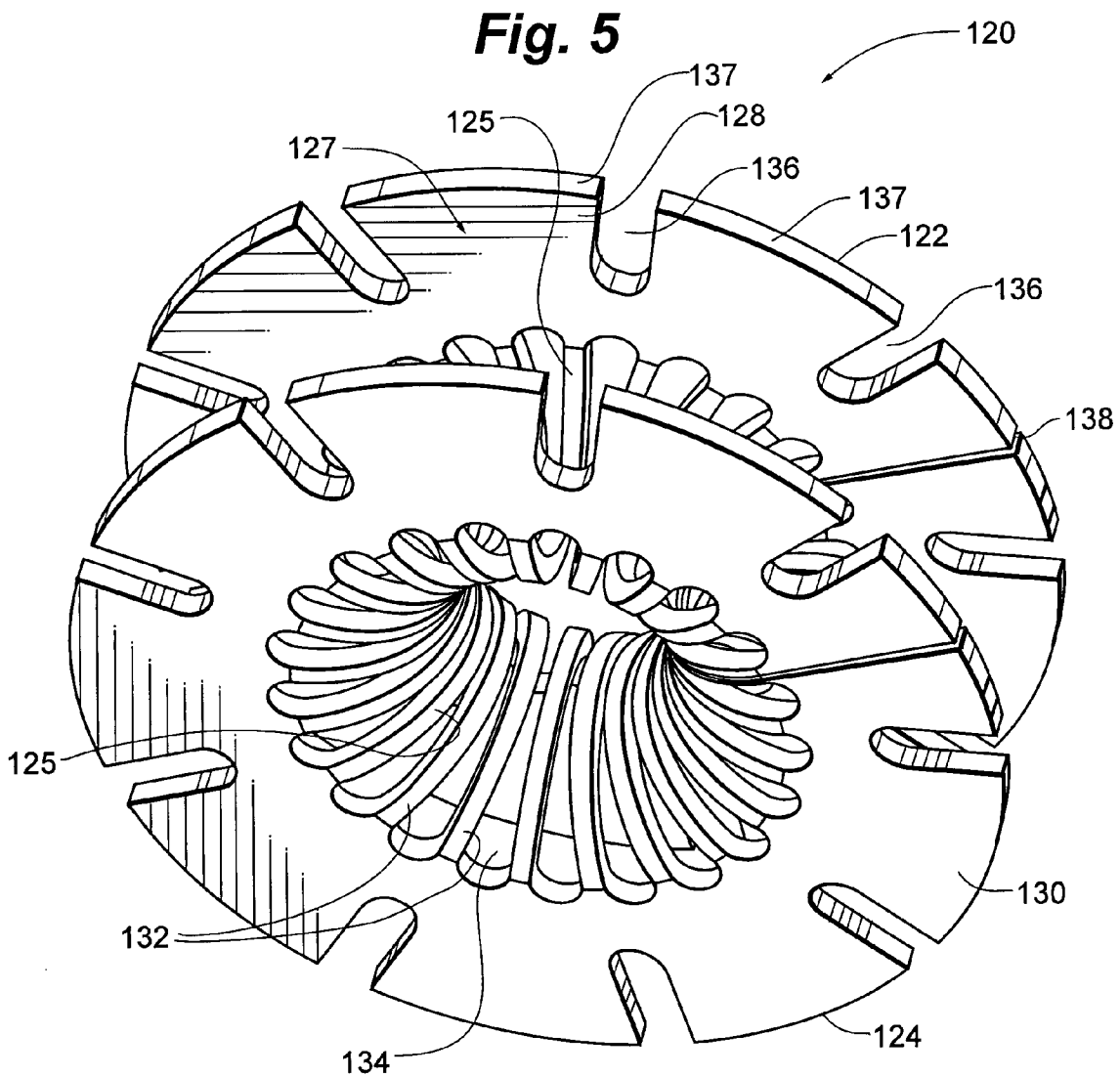
FIG. 5 is a perspective view of another connector body having radially directed edge slots in the body flanges for receiving mechanically deformable tubes.

FIG. 5 illustrates another electrical connector body 120 having generally a first flange, end wall or lip 122 and a second flange, end wall or lip 124. First end wall 122 and second end wall 124 can also be referred to together as the outer circumferential portion. First end wall 122 has an outer edge 137 and an inner surface 128. Second end wall 124 includes an outer surface 30. First end wall 122 and second end wall 124 may be seen to have an inner circumferential curved wall 125 formed by a plurality of ribs 132 separated by a plurality of inter-rib spaces 134. The inner circumferential wall and ribs may be seen to be disposed about a central aperture 126. An outer facing circumferential groove 127 may be disposed about inner circumferential wall 125 and between first and second end walls 122 and 124. Inspection of FIG. 5 shows that ribs 132, being radially flexible, can move independently of each other. This independent movement can provide better electrical continuity between electrical connector body 120 and an irregular shaped inserted electrode.

Connector body 120 also includes several outer, radially directed edge slots 136. Slots 136 can be used to secure inserted crimp tubes. In some embodiments, a tube is disposed between the longitudinally aligned slots 136 and secured to connector housing 120 by welding. An electrical conductor can then be inserted within the tube and the tube crimped about the inserted conductor. A seam 138 may be seen in FIG. 5, an artifact of manufacture.

Figure 6:
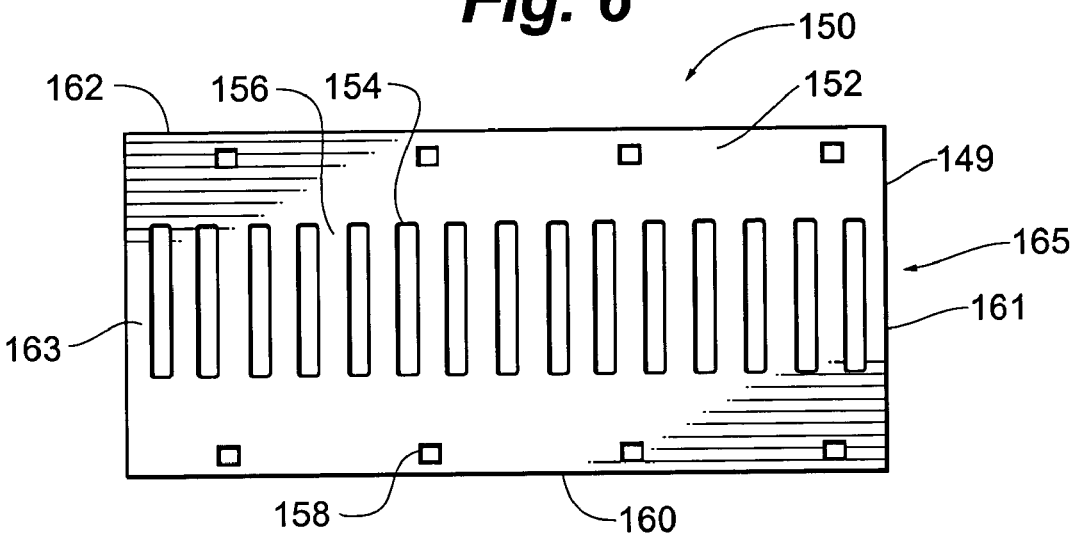
FIG. 6 is a side view of a metal sheet, having edge holes and numerous slots formed through the sheet for use in making a connector body.

FIG. 6 illustrates a metal plate or metal sheet 149 that can be used to form an electrical connector body 150. Unless otherwise stated, dimensions and materials given for various sheets and connector embodiments of the present invention apply to all similarly named elements in other embodiments. Sheet 149 includes a first or bottom edge 160, a second or top edge 162, a third or side edge 161, a fourth or side edge 163, and can include a non-perforated, solid portion 152, as well as numerous ribs 156 separated by inter-rib apertures 154. Ribs 156 and apertures 154 extend along an intermediate region 165 that extends between edges 161 and 163 and runs substantially parallel to edges 162 and 160. Intermediate region 165 can later form an electrical contacting portion of the connector. Ribs 156 may be seen to be supported at each end in the embodiment illustrated. Ribs and fingers can have a width of less than 0.1 or 0.070 inch, a length of less than about ¼ inch, and be separated by apertures of less than about 0.1 or 0.070 inch width, in various, non-limiting examples of the invention. Preformed, stamped, or etched sheet 149 may also be seen to have several edge holes 158. Holes 158 may later be used to secure electrical conductors, either directly or indirectly.

Figure 7:
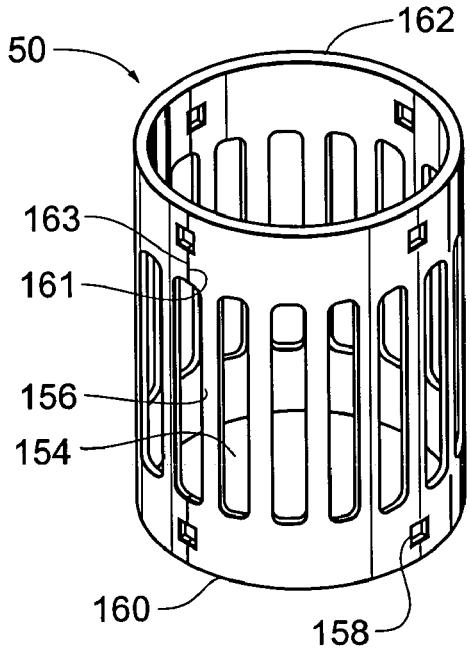
FIG. 7 is a perspective view of the metal sheet of FIG. 6 after being rolled into a cylinder.

FIG. 7 illustrates connector body 150 after sheet 149 has been rolled or shaped into a cylinder. First edge 160 may be seen as may second edge 162. Edges 161 and 163 may be seen to be in an opposed, close relationship to each other.

Figure 8:
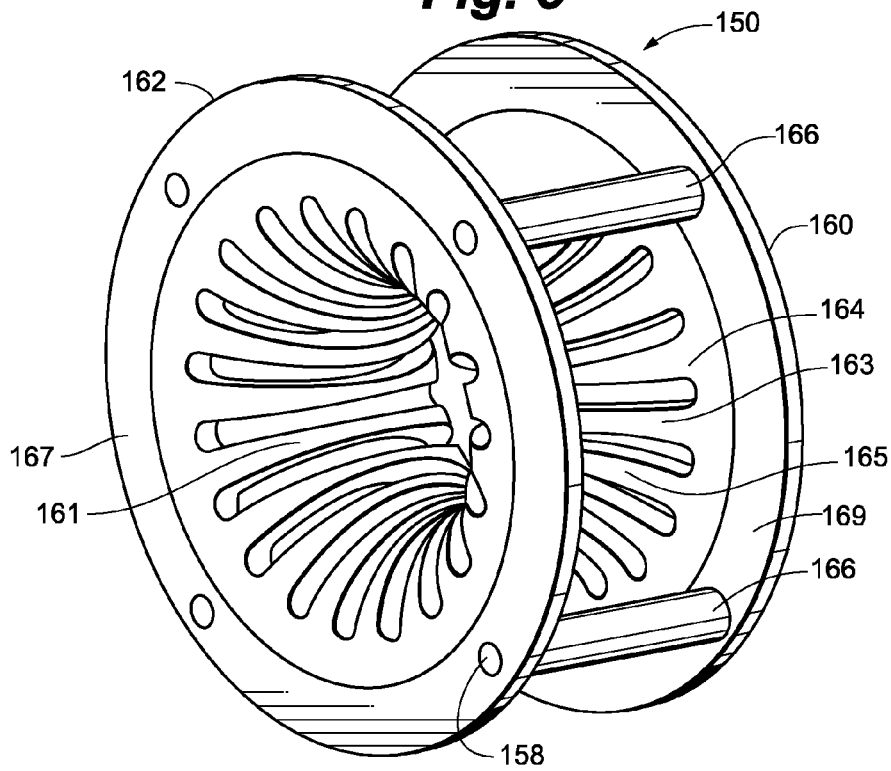
FIG. 8 is a perspective view of the metal sheet of FIG. 7 after being formed into a twin flange shape and having crimpable tubes secured between the flanges.

FIG. 8 illustrates connector body 150 after the material has been further bent or formed from the cylinder shape of FIG. 7 to impart the outer facing, annular, circumferential groove 164. Bottom edge 160 and top edge 162 have been brought closer together. Intermediate region 165 now has a concave outer facing surface 163 forming the outer facing circumferential groove 164 and an inner facing convex surface 161 as well. Inner facing convex surface 161 curves radially outward to form the end wall outer surface 167 and outer facing concave surface 163 curves radially outward to form the end wall inner surface 169. Tubes 166 have been aligned between holes 158 and affixed to the opposing end walls across the concave surface. Tube 166 can be braised, soldered, welded, or secured using other methods known by those skilled in the art. Tubes 166 can have conductors inserted within, and then mechanically deformed to crimp about the inserted conductor. In some methods, the sheet is first shaped to bring the side edges closer together, followed by bending the sheet to form the concave and convex surfaces. In other methods, the sheet is first bent to form the concave and convex surfaces followed by shaping the sheet to bring the side edges closer together. The terms "bent", "shaped", and "formed" are used interchangeably.

Figure 9:
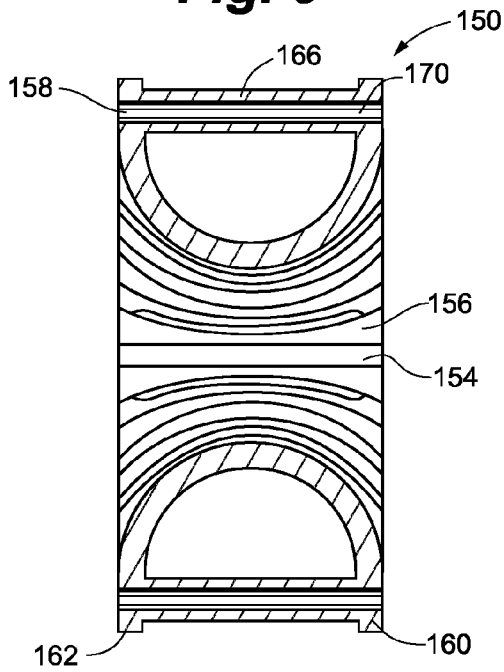
FIG. 9 is a longitudinal, cross sectional view of the electrical connector body of FIG. 8.

FIG. 9 illustrates connector body 150 from a longitudinal, cross sectional view. A lumen 170 may be seen extending through tube 166 and opening 158. As previously discussed, a conductor, for example a conductor wire, can be inserted into lumen 170, and tube 166 mechanically deformed or crimped about the inserted conductor.

The connector body, such as connector body 150 of FIG. 6, can have the holes or apertures through the metal formed using any suitable technique, including stamping, laser machining, and/or chemical etching. One technique uses photolithography to coat a metal sheet with photo resist in a desired pattern, expose the photo resist coated metal to light energy, and remove the unexposed photo resist, unprotected metal, and exposed photo resist, as is well known to those skilled in the art. Photolithography can be used to form other suitable connector body patterns than those illustrated in FIG. 6. Various metals may be used to form the sheet and connector. Stainless steel can be used as the sheet material, with the sheet plated with gold or platinum. The sheet can be between about 0.003 and 0.005 inch in thickness in some embodiments.

Figure 10:
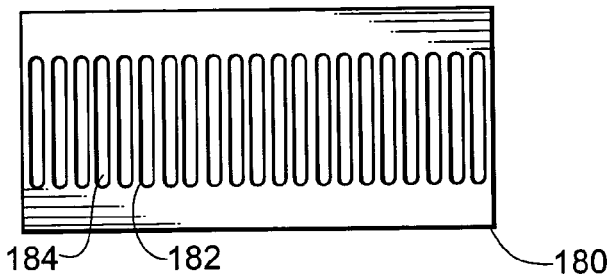
FIG. 10 is a side view of another metal sheet, having ribs or bridges, for use in forming an electrical connector body.

FIG. 10 illustrates another connector body sheet 180 having another pattern. Sheet 180 has several ribs or bridges 182 separated by inter-rib or inter-bridge apertures 184. Ribs 182 may also be described as electrically conductive flexible members or thin flexible members. Electrical connector body 180 is similar to body 150 of FIG. 6, but not having edge holes apart from the inter-rib apertures.

Figure 11:
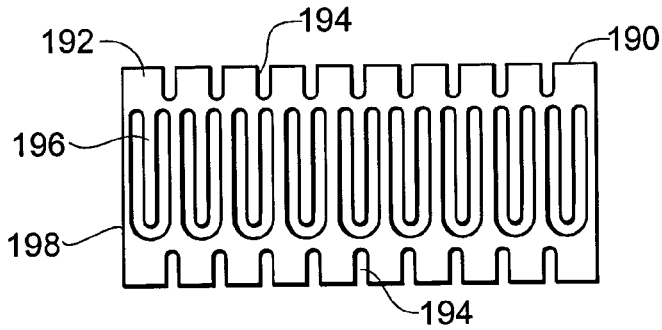
FIG. 11 is a side view of yet another metal sheet, having cantilevered fingers and edge slots, for forming an electrical connector body.

FIG. 11 illustrates yet another connector body sheet 190 having another pattern. Sheet 190 includes a solid, non-perforated portion 192 and several radially outward directed edge slots 194, similar to those described with respect to FIG. 5. In connector body 190, the radially flexible members are provided by cantilevered members or fingers 196 separated by U-shaped apertures 198 about much of the finger.

Figure 12:
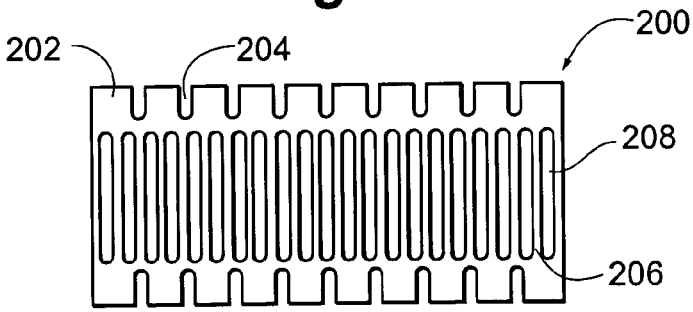
FIG. 12 is a side view of still another metal sheet, having ribs or bridges and edge slots, for use in forming an electrical connector body.

FIG. 12 illustrates still another connector body sheet 200 having a non-perforated portion 202, radially outwardly directed slots 204, ribs or bridges 206, and inter-rib apertures 208. A pattern such as that illustrated in FIG. 12 may be used to form the connector body illustrated in FIG. 5.

Figure 13:
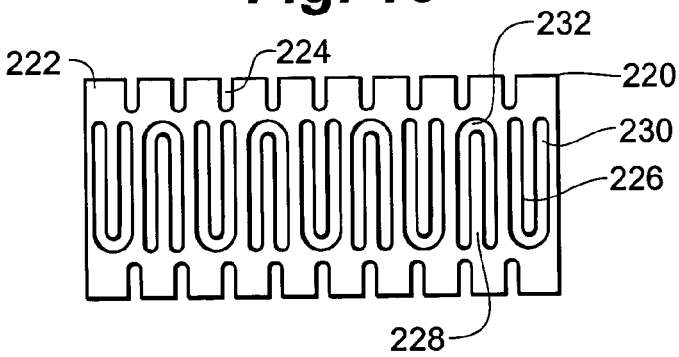
FIG. 13 is a side view of another metal sheet, having ribs, opposed fingers, and edge slots, for forming an electrical connector body.

FIG. 13 illustrates still another connector body sheet 220 having a non-perforated portion 222, radially outwardly directed edge slots 224, and several cantilevered members or fingers 226 directed in what will be called a first longitudinal direction as well as a second set of cantilevered members or fingers 228 directed in what will be referred to an opposite longitudinal direction in the finished connector. The oppositely directed cantilevered members may also be described as being parallel to one another but pointed in the opposite directions from each other. Cantilevered members 226 and 228 may be seen disposed within oppositely directed U-shaped apertures 230 and 232 respectively.

Figure 14:
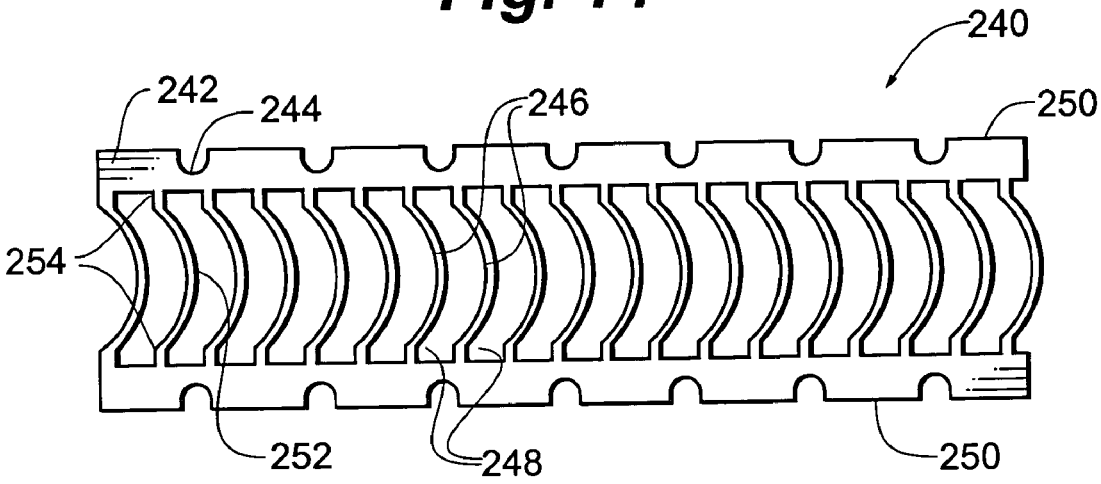
FIG. 14 is a side view of another metal sheet, having curved ribs and edge slots, for forming an electrical connector body.

FIG. 14 illustrates still another connector body sheet 240 having a non-perforated portion 242, edge regions 250, radially outwardly directed slots 244, curved ribs or bridges 246, and inter-rib apertures 248. Ribs 246 include rib edge portions 254 located near sheet edge portions 250, and a center portion 252 that is curved longitudinally relative to rib edge portions 254. A pattern such as that illustrated in FIG. 14 may be used to form a connector body having ribs that are curved in the longitudinal direction in the innermost portion of the connector about the longitudinal aperture. The longitudinally curved ribs may provide a reduced insertion force for an inserted member.

The invention claimed is:

1. An implantable electrical connector having a longitudinal axis and an inner longitudinal aperture therethrough, the connector comprising:

a body including a first flange and a second flange, each of the first and second flanges having an outer edge and at least one region disposed substantially orthogonal to the longitudinal axis and having an inner surface and an outer surface, wherein each of the first and second flanges are formed from the same sheet of material as an electrically conductive and radially flexible inner circumferential wall portion having an inner facing convex surface and an outer facing concave surface and constructed of flexible material disposed about the inner longitudinal aperture and including a plurality of ribs having first ends and second ends and separated by inter-rib spaces and supported and connected to each other at the first ends by the first flange and at the second ends by the second flange, and wherein the inner facing convex surface curves radially outward to form the outer surfaces of the first and second flanges and the outer facing concave surface curves radially outward to form the inner surfaces of the first and second flanges; and an elastic member disposed around the entire flexible inner circumferential wall portion.

2. A electrical connector as in claim 1, further comprising at least one tube affixed to the first flange and having at least one mechanically deformable sidewall for mechanically securing an electrical conductor inserted within the tube.

3. A electrical connector as in claim 1, further comprising a tube extending between and secured to the outer surfaces of the first and second flanges, wherein the tube has a mechanically deformable sidewall.

4. A electrical connector as in claim 1, further comprising a pair of support washers, one secured to each of the flanges.

5. A electrical connector as in claim 1, wherein the ribs are substantially parallel to each other and substantially parallel to the body longitudinal axis at their inner-most extent.

6. An implantable electrical connector assembly comprising:

an implantable electrical connector comprising a longitudinal axis and an inner longitudinal aperture there through, the connector further comprising: a body including a first flange and a second flange, each of the first and second flanges having an outer edge and at least one region disposed substantially orthogonal to the longitudinal axis and having an inner surface and an outer surface, wherein the first and second flanges are formed from the same sheet of material as an electrically conductive and radially flexible inner circumferential wall portion having an inner facing convex surface and an outer facing concave surface and constructed of flexible material disposed about the inner longitudinal aperture and including a plurality of ribs having first ends and second ends and separated by inter-rib spaces and supported and connected to each other at the first ends by the first flange and at the second ends by the second flange, wherein the inner facing convex surface curves radially outward to form the outer surface of the first flange and the outer facing concave surface curves radially outward to form the inner surface of the flange; and an elastic member disposed around the entire flexible inner circumferential wall portion; and an electrical conductor secured to the connector by a non-welded, mechanical attachment.

7. An implantable electrical connector assembly as in claim 6, further comprising at least one hole or slot extending through each of the first flange and the second flange from the inner surface to the outer surface.

8. An implantable electrical connector assembly as in claim 7, further comprising an electrically conductive tube extending between the hole or slot in the first flange and the hole or slot in the second flange, wherein the tube has a mechanically deformable sidewall.

9. An implantable electrical connector assembly as in claim 6, wherein the conductor includes a nickel alloy cladding over a silver core wire.

* * * * *